US007104474B2

(12) United States Patent
Katz et al.

(10) Patent No.: US 7,104,474 B2
(45) Date of Patent: Sep. 12, 2006

(54) CONTAINER CLEANING DEVICE

(75) Inventors: Jonathan M. Katz, Solon, OH (US); Stephen P. Rukavina, Bedford Heights, OH (US); Richard D. Boozer, Wakeman, OH (US)

(73) Assignee: Vita-Mix Corporation, Cleveland, OH (US)

( * ) Notice: Subject to any disclaimer, the term of this patent is extended or adjusted under 35 U.S.C. 154(b) by 0 days.

(21) Appl. No.: 10/750,269

(22) Filed: Jan. 2, 2004

(65) Prior Publication Data

US 2005/0145717 A1 Jul. 7, 2005

(51) Int. Cl.
*B05B 1/32* (2006.01)

(52) U.S. Cl. ..... 239/459; 239/457; 239/541

(58) Field of Classification Search ..... 239/541, 239/539, 537, 579, 459, 460, 456; 285/305, 285/316; 251/149.6, 339; 222/507, 518; 15/104.9

See application file for complete search history.

(56) References Cited

U.S. PATENT DOCUMENTS

| | | | | | |
|---|---|---|---|---|---|
| 930,444 | A * | 8/1909 | Warren | 239/459 |
| 2,009,575 | A * | 7/1935 | Card, Jr. | 251/322 |
| 2,536,167 | A * | 1/1951 | Gilmour | 239/460 |
| 2,570,909 | A * | 10/1951 | Benson et al. | 251/144 |
| 2,621,076 | A * | 12/1952 | Barton | 239/288.5 |
| 3,006,560 | A * | 10/1961 | Rosenkranz | 239/456 |
| 4,219,162 | A * | 8/1980 | Dadson | 239/583 |
| 4,562,960 | A * | 1/1986 | Marty et al. | 239/72 |
| 4,697,610 | A * | 10/1987 | Bricker et al. | 137/3 |
| 5,238,221 | A * | 8/1993 | Schwaderer et al. | 251/89 |
| 5,806,832 | A * | 9/1998 | Larbuisson | 251/149.6 |
| 5,901,906 | A * | 5/1999 | Bouldin | 239/229 |
| 6,341,706 | B1 * | 1/2002 | Neuner | 215/40 |

OTHER PUBLICATIONS

"The Little Red Rinser" brochure of Blendtec of Orem, Utah, 2 pages (undated).

Drawing of a prior art product of Vita-Mix Corporation of Cleveland, Ohio (as described in the Specification) (undated).

* cited by examiner

*Primary Examiner*—Christopher Kim
(74) *Attorney, Agent, or Firm*—Renner, Kenner, Greive, Bobak, Taylor & Weber

(57) ABSTRACT

A device (10) for cleaning the inside of a container includes a base (11) carrying a tube (12). A hose (50) is received within the base (11) and is connected at one end to the bottom of the tube (12) and at the other end to a source of water via a quick disconnect assembly (60). A spray head (21) houses a plunger (30) which has a base (31) and a nose (32). A spring (37) urges the nose (32) of the plunger (30) out through an aperture (40) in the spray head (21). A flat washer seal (42) is positioned with a majority of its surface on a shelf (41) formed in the spray head (21). Ribs (43) on the shelf (41) engage the seal (42) on one side, and a rim (44) on the base (31) engages the other side of the seal (42). The quick disconnect assembly (60) includes a valve (66) which is maintained closed by a spring (67) so that when the hose (50) is disconnected from the source of water, or the water supply pressure is lost, backflow is prevented. When a container is inverted and its bottom pushed down on the top of the nose (32) of the plunger (30), the base (31) of the plunger (30) is moved away from the seal (42) to allow water to be emitted from spray head (21) through axial apertures (70) and radial apertures (71).

12 Claims, 4 Drawing Sheets

CONTAINER CLEANING DEVICE

TECHNICAL FIELD

This invention relates to a device for cleaning a container. More particularly, this invention relates to a device which can emit a high pressure spray to clean the inside of a liquid food container such as a pitcher or the like.

BACKGROUND ART

Many liquid food containers, such as pitchers and the like, are difficult to clean, primarily because of their depth. Moreover, these types of containers are often in need of frequent cleaning, for example, in commercial environments, such as a restaurant or cocktail lounge, where the pitcher component of a blender may be continually used to blend different drinks.

One possible way to clean these deep containers is to provide a nozzle-like device at the end of a hose. Such, however, requires the close attention of the user who must hold the container with one hand and the nozzle with the other while directing the spray to various locations in the container.

In an alternative solution to the problem, a low profile platform has been provided with an upwardly directed nozzle which is in communication with a water source. A container to be cleaned is inverted, and when its rim engages the platform, a spray is emitted from the nozzle. However, such a device does not assure the complete cleaning of the entire container, particularly those that are quite deep. Moreover, the low profile unit is particularly ineffective for cleaning the bottom of a container, and when the container bottom includes blades, as would be found in a container of a blender, the bottom of the blades are particularly difficult to clean.

As a result, a device has been developed wherein the nozzle is positioned on top of a vertically oriented tower which extends upwardly from a base. The tower can be placed in communication with water under pressure. When the bottom of an inverted container is pressed against the top of the tower, a spray is emitted at that location. A problem with this type of device, however, relates to the seal that must be provided at the top of the tower, which problem is compounded in low pressure water conditions. The seal in this device was formed by a conical surface being forced against a face of a flat washer. There was a large amount of surface contact which, therefore, required a relatively high amount of force to maintain the seal. As a result, low water pressure conditions might well cause leakage.

Thus, the need exists for a device which will clean containers of all reasonable sizes without the problems of the prior art.

DISCLOSURE OF THE INVENTION

It is thus an object of the present invention to provide a device which can reliably be used to clean a wide variety of food and beverage containers.

It is another object of the present invention to provide a device, as above, which is provided with an improved seal at the area of the nozzle.

It is a further object of the present invention to provide a device, as above, which will satisfactorily operate at low pressure water conditions.

It is an additional object of the present invention to provide a device, as above, which can be quickly and easily attached to, and detached from, a water source such as a faucet.

It is yet another object of the present invention to provide a device, as above, which will not leak when it is detached from a faucet.

These and other objects of the present invention, as well as the advantages thereof over existing prior art forms, which will become apparent from the description to follow, are accomplished by the improvements hereinafter described and claimed.

In general, a device for emitting water into the inside of a container made in accordance with one aspect of the present invention includes a tube having one end adapted to be attached to a source of water. A spray head is carried by the other end of the tube, and a plunger normally has one end extending out of the spray head. A seal is provided in the spray head, and the plunger includes a rim to press into the seal.

In accordance with another aspect of the invention, the device includes a tube having one end adapted to be attached to a source of water. A spray head is carried by the other end of the tube, and a plunger normally has one end extending out of the spray head. A shelf is formed in the spray head to receive a seal with the majority of the surface of the seal being positioned on the shelf.

In yet another aspect of the invention, the device includes a tube having one end adapted to be attached to a source of water with a spray head being carried by the other end of the tube. A plunger is positioned in the spray head, and a spring in the spray head urges one end of the plunger out of the spray head.

According to an additional aspect of the present invention, the device includes a tube with one end of a hose attached to one end of the tube. A spray head is carried by the other end of the tube. The other end of the hose includes a connecting device adapted to be attached to a source of water. The connecting device includes a valve, and a spring maintains the valve closed when the connecting device is detached from the source of water to maintain any water in the hose.

A preferred exemplary device for cleaning a container incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
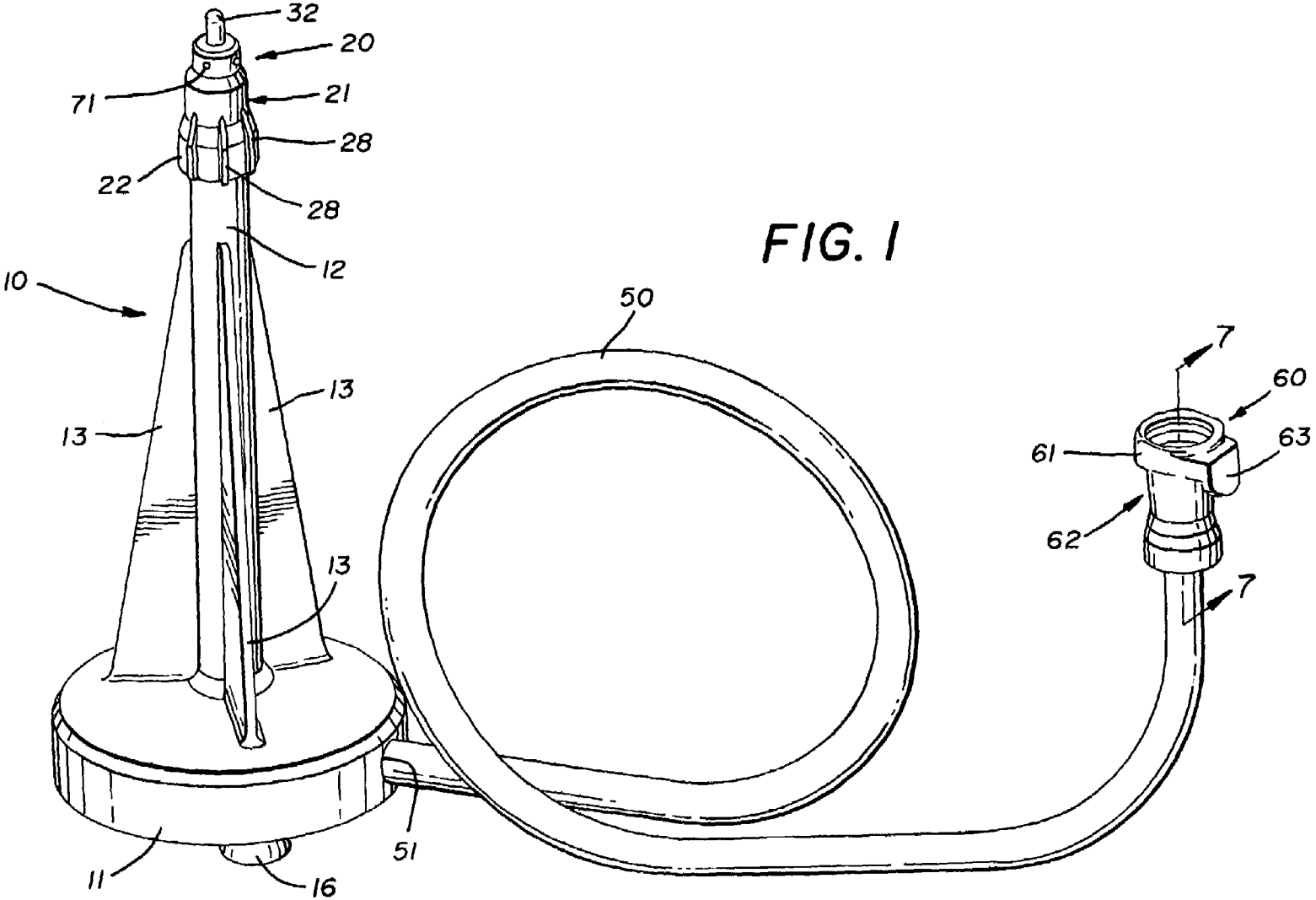
FIG. 1 is a perspective view of a device for cleaning a container made in accordance with the concepts of the present invention.

A device for cleaning the inside of a container is indicated generally by the numeral 10, the majority of the components thereof preferably being molded of a suitable plastic material such as acrylonitrile butadiene styrene (ABS) or similar material. Device 10 includes a generally cylindrical plastic base 11 which preferably integrally carries an upstanding plastic tube 12 which is open at its bottom into base 11. A plurality of tapered fins 13 may be provided between the outer wall of tube 12 and base 11 to provide strength to tube 12. Base 11 may be provided with a plurality of slots 14, one being shown in FIG. 2, each of which receives a stem 15 of a suction cup-like foot 16. Feet 16 thus enable device 10 to be securely positioned on a surface, usually a sink or other surface communicating with a fluid drain.

A nozzle assembly, generally indicated by the numeral 20, is carried at the top of tube 12. Nozzle assembly 20 includes a plastic spray head generally indicated by the numeral 21. Spray head 21 generally takes on the configuration of an inverted cup having a generally cylindrical outer surface 22 and a generally flat top surface 23. The lower inside of surface 22 is threaded, as at 24, to engage threads 25 formed at the top of the outer wall of tube 12 so that nozzle assembly 20 may be attached to tube 12. A slot 26 may be formed in the outer wall of tube 12 adjacent to threads 25 to received an O-ring 27 to provide a fluid seal between tube 12 and nozzle assembly 20. Outer surface 22 of spray head 21 is also shown as having a plurality of ribs 28 which assist in the tightening of head 21 on the threads 24 of tube 12.

Figure 6:
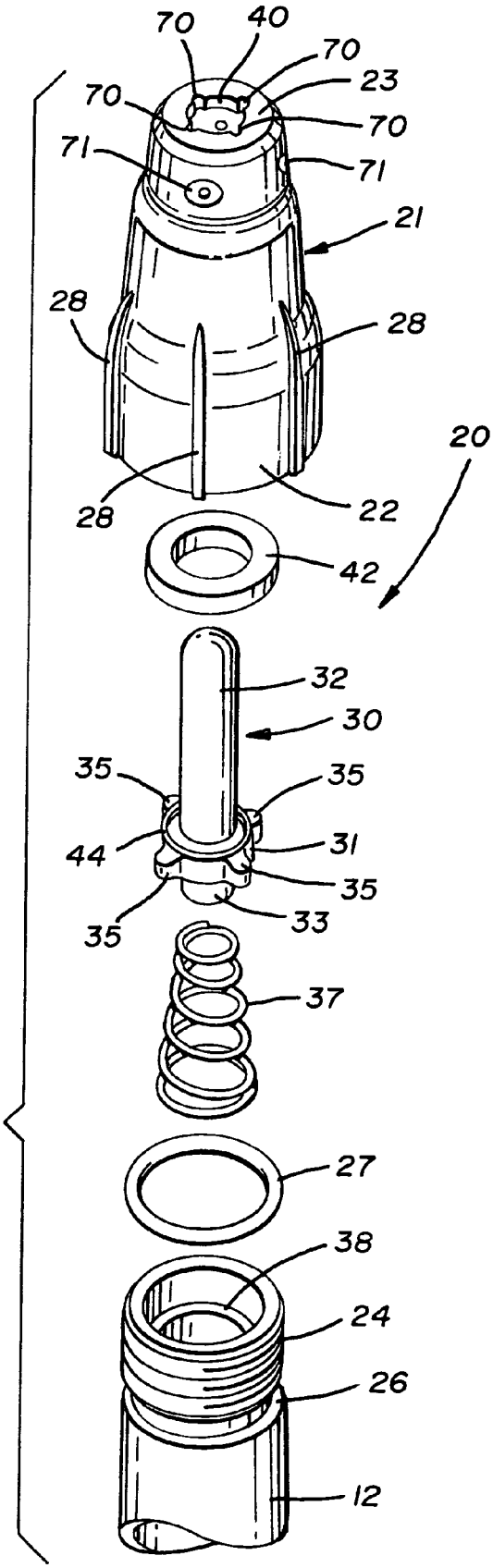
FIG. 6 is an exploded, perspective view of the nozzle area of the device of FIG. 1.

Nozzle assembly 20 also includes a plastic plunger generally indicated by the numeral 30. Plunger 30 includes a generally cylindrical base 31 having an elongate, generally cylindrical, nose 32 extending upwardly therefrom, and a generally cylindrical stem 33 extending downwardly therefrom. A slot 34 may be formed in at least a portion of plunger 30 for ease of molding this plastic part, as would be evident to one of ordinary skill in the art. A plurality of wings 35 (FIG. 6) extend radially outward from plunger base 31 to maintain plunger 30 centered relative to the inner wall 36 of spray head 21.

Figures 2, 7:
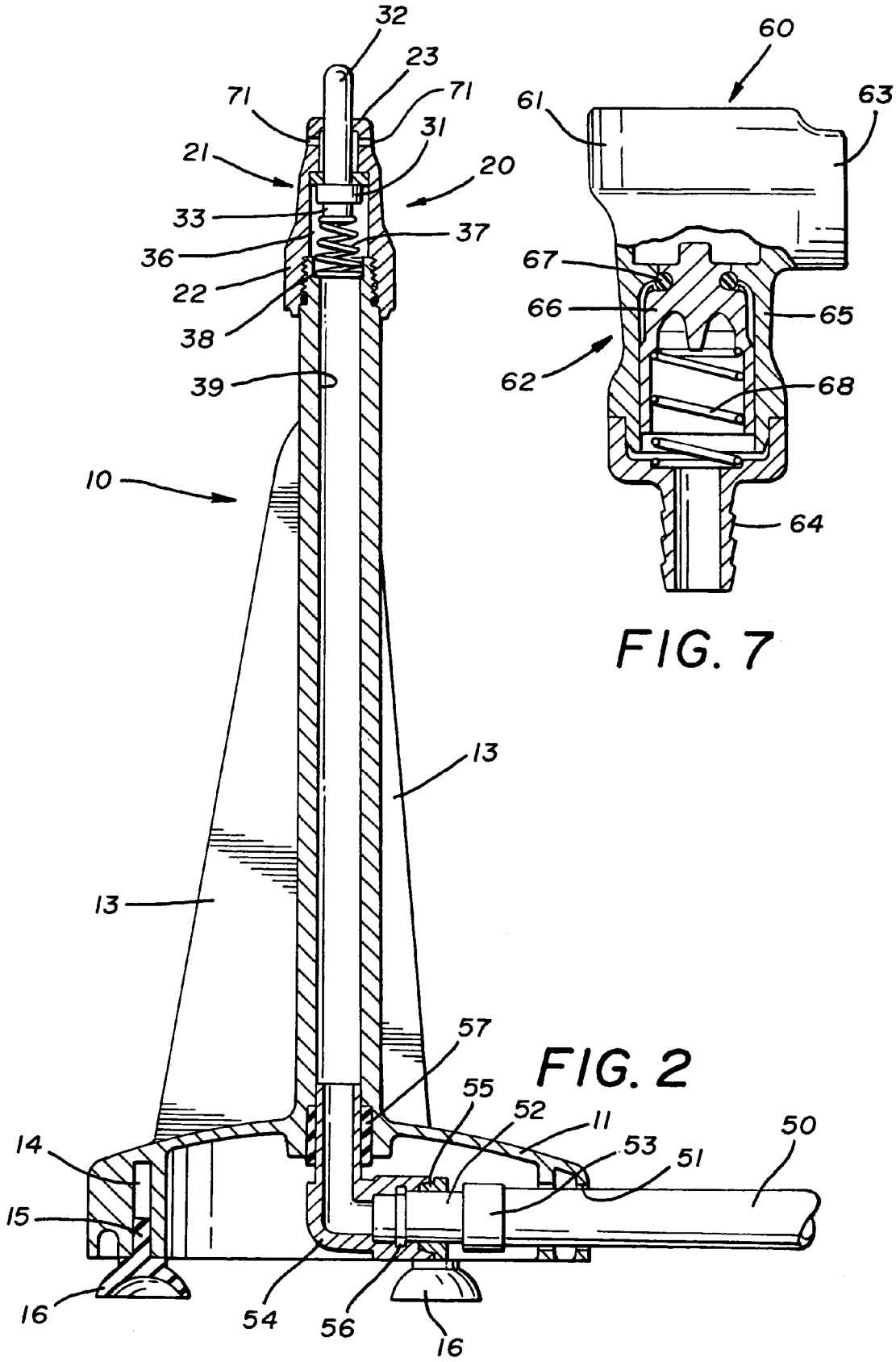
FIG. 2 is a vertical sectional view of a portion of the device of FIG. 1.
FIG. 7 is a partial sectional view taken substantially along line 7—7 of FIG. 1.
Figure 3:
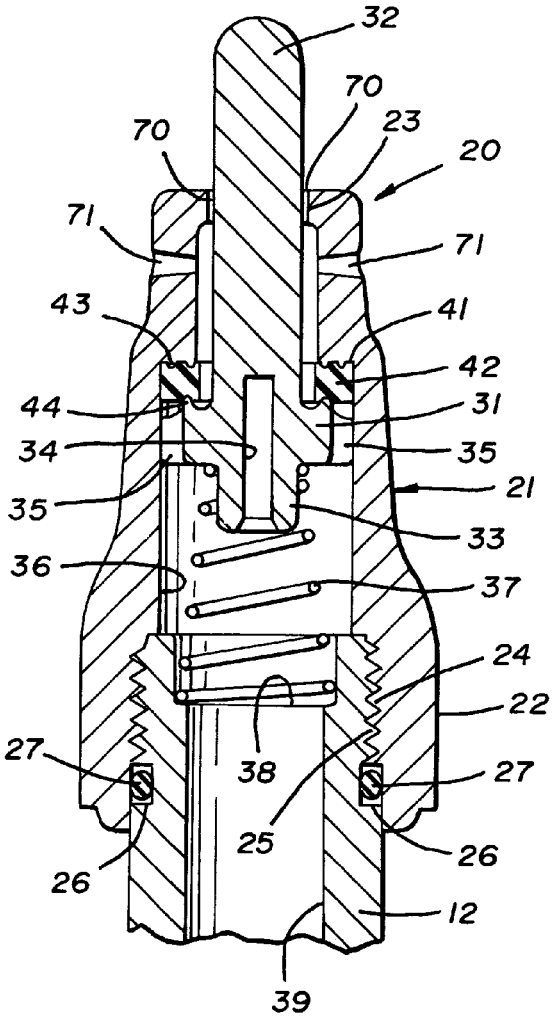
FIG. 3 is an enlarged sectional view of the nozzle area of the device of FIG. 1, showing the nozzle in the closed condition.

The top of a coil spring 37 is received around the stem 33 of base 31 and bears against the underside of base 31. The other end of spring 37 bears against a step 38 formed on the inside surface 39 of tube 12. Spring 37 thus urges plunger 30 upwardly such that its nose 32 normally extends through an aperture 40 formed in the top surface 23 of spray head 21, as shown in FIGS. 1, 2 and 3. Spring 37 is particularly useful to maintain nose 32 extended through aperture 40 during potential low pressure water conditions.

Figure 5:
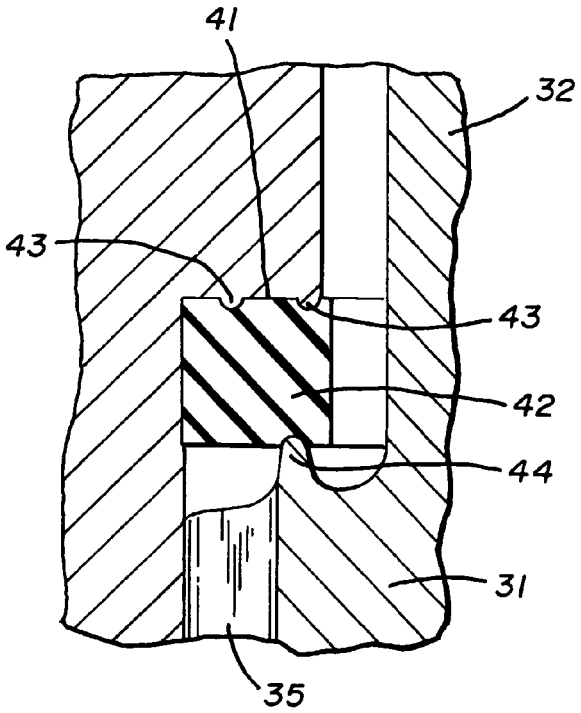
FIG. 5 is an enlarged sectional view of the improved seal of the device of the present invention.

A shelf 41 is formed in spray head 21 to receive a flat washer seal 42 thereon. As best seen in FIG. 5, shelf 41 includes two protruding ribs 43 which can press into seal 42 to create a better seal. To that end, seal 42 is preferably made of a material capable of being produced in a 70–75 durometer such as a neoprene or an ethylene propylene diene rubber (EPDM). It should also be noted that the vast majority of the surface of washer seal 42 is received on shelf 41. Thus, at least eighty percent, and preferably about ninety percent, of the surface of seal 42 is received on shelf 41. As will hereinafter become evident, such prevents "blow-out" of seal 42 under high pressure and/or high temperature conditions.

As also best seen in FIG. 5, base 31 of plunger 30 is provided with an upstanding circumferential rim 44 which can press into the lower surface of washer seal 42 to provide a better seal when device 10 is in the closed position shown in FIG. 3.

As shown in FIGS. 1 and 2, a hose 50 may be used to permit tube 12 to communicate with a source of water under pressure, such as a faucet. Hose 50 may be received through an aperture 51 formed at the periphery of base 11 and is then fluidly attached to the bottom of tube 12 in a rather conventional fashion. For example, an adapter 52 may be affixed to hose 50 by means of barbs that protrude radially, outwardly to engage the inside of hose 50. Such an adapter is readily available from John Guest USA, Inc. of Pine Brook, N.J., part no. PI2516125. A clamp 53 can be received at the joint of hose 50 and adapter 52 to further secure the connection.

The other end of adapter 52 may be received by one end of an elbow 54 which is also a conventional item purchased from John Guest USA, Inc., part no. PI2216165. Elbow 54 is secured to adapter 52 by a bushing 55, and an O-ring 56 seals the junction. The other end of elbow 54 is received inside of the bottom of tube 12 and is secured thereto by a bushing 57 having a locking collet that exerts an inward radial force on the elbow with increased water pressure. Such a device is also purchasable from John Guest USA Inc., as part no. PI28165.

The other end of hose 50 is provided with a quick disconnect assembly generally indicated by the numeral 60. Quick disconnect assembly 60 includes a standard male connector 61 which is threaded to be attached to a faucet. Typical of such a connector 61 is part no. 9400400 purchasable from Colder Products Company of St. Paul, Minn.

Connector 61 is received within the female portion, generally indicated by the numeral 62, of quick disconnect assembly 60. As best shown in FIG. 7, female portion 62 includes the conventional push button release mechanism 63 at one end and is provided with a hose barb 64 at the other end to engage hose 50. Female portion 62 of quick disconnect assembly 60 includes a housing 65 which is provided with a valve 66 with an O-ring seal 67. A low force coil spring 68 maintains valve 66 closed. Thus, when water under pressure is received by female portion 62, valve 66 will open to permit water to be received by hose 50, the water pressure being the only force which opens valve 66. Then when there is no water pressure acting on valve 66, spring 68 will keep valve 66 closed to prevent backflow out of hose 50. Thus, when push button 63 is depressed to remove female portion 62 from male connector 61, and thus remove device 10 from its source of water, backflow or leaking of water from hose 50 is prevented. Backflow is also prevented if the water supply pressure is lost. As such, contaminants that may be in device 10 cannot travel back into the water supply and contaminate drinking water.

In the operation of device 10, when hose 50 is connected to a faucet or other source of water under pressure, and when the faucet is open, water is received in tube 12. The combination of the water pressure and spring 37 maintains plunger assembly 30 up, and device 10 thus is in the closed position shown in FIGS. 1, 2 and 3. As such, rim 44 of base 31 of plunger assembly 30 is pressed into flat washer seal 42 to maintain a fluid seal above plunger base 31.

Figure 4:
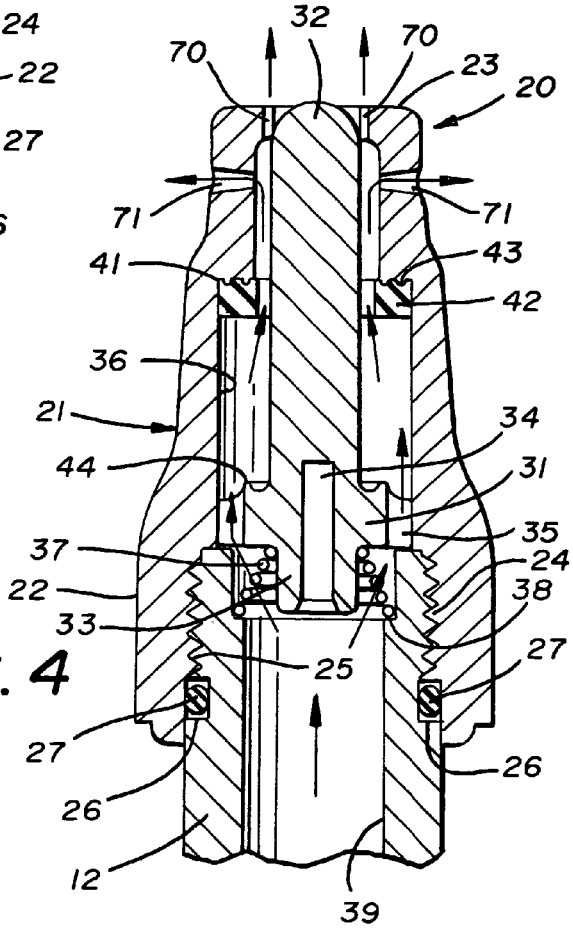
FIG. 4 is a view similar to FIG. 3 but showing the nozzle in the open condition.

In this position, device 10 is in condition for immediate activation. To do so, a container or other item to be cleaned is inverted and telescoped over tube 12 until its bottom engages the top of the plunger nose 32. At this point, further downward movement of the container depresses plunger 30 against the pressure of the water and compresses spring 37 from the FIG. 3 position to the FIG. 4 position. As such, as shown in FIG. 4, water under pressure is allowed to pass around base 31 of plunger 30 between the wings 35 thereof, between nose 32 and flat washer seal 42, and out of the nozzle assembly 20 through axial spray apertures 70 formed in the top surface 23 of spray head 21 adjacent to aperture 40. Water under pressure may also be emitted through radial spray apertures 71 formed in the side of spray head 21. As such, both the bottom and the sides of the container receive a high pressure spray until the downward force on plunger 30 is terminated at which time device 10 returns to the FIG. 3, shut off, position. At this time, if it is desired to activate quick disconnect assembly 60 to remove portion 62 thereof from connector 61 and thereby detach hose 50 from the source of water, backflow of water out of hose 50 is prevented because spring 67 will maintain valve 66 closed.

If any of the components of nozzle assembly 20 need to be replaced, spray head 21 need only be unthreaded from tube 12 to gain access to the components of nozzle assembly 20. However, because the highest wear component is plunger 30, and in particular nose 32 thereof, in an alternative embodiment thereof, shown in FIG. 8, the plunger nose can be replaced without removing spray head 21 from tube 12.

Figure 8:
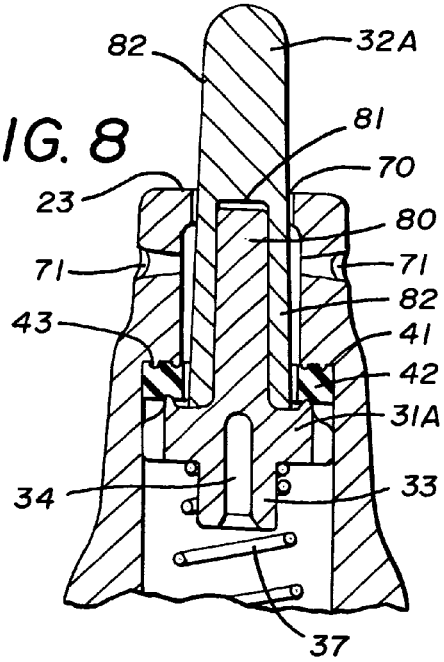
FIG. 8 is a view similar to FIG. 3 showing an alternative embodiment of a plunger of the present invention.

Thus, as shown in FIG. 8, the plunger base and plunger nose are shown as being in two separate pieces, 31A and 32A, respectively. All other components of nozzle assembly 20 are the same in FIG. 8 as in the other Figs. and have, therefore, been given the same reference numerals. Plunger base 31A includes an upwardly extending stem 80, and plunger nose 32A includes a hollowed-out area 81 which is adapted to be slip fit over the stem 80. The outer wall 82 of plunger nose 32A is provided with a slight draft or taper rendering the bottom of wall 82 slightly larger than the top of wall 82. The difference in diameters may be preferably on the order of five thousandths of an inch, and for the majority of the length of wall 82, its diameter is smaller than aperture 40 of spray head 21, so that the plunger will operate as previously described. However, its diameter at the lower end is slightly larger than the size of aperture 40 to prevent nose 32A from popping out of spray head 21. But if sufficient force is applied, nose 32A may be removed from stem 82 and from spray head 21 for potential replacement without removing head 21 from tube 12.

In view of the foregoing, it should be evident that a device 10 constructed as described herein, accomplishes the objects of the invention and otherwise substantially improves the art.

What is claimed is:

1. A device for emitting water into the inside of a container comprising a tube having one end adapted to be attached to a source of water, a spray head carried by the other end of said tube, a plunger having a nose at one end normally extending out of said spray head and a base at the other end, a spring in said spray head engaging said base to urge said nose of said plunger out of said spray head, and a seal in said spray head, said base having wings extending radially outwardly therefrom and a rim extending upwardly therefrom to press into one side of said seal, and said spray head having at least one rib to press into the other side of said seal.

2. The device of claim 1 further comprising a shelf formed in said spray head, said seal having a surface the majority of which is received on said shelf.

3. The device of claim 2 further comprising a hose having one end attached to said one end of said tube, a device at the other end of said hose and adapted to be attached to a source of water, said device including a valve and a spring to maintain said valve closed when said device is detached from the source of water to maintain any water in said hose.

4. The device of claim 1 further comprising a hose having one end attached to said one end of said tube, a device at the other end of said hose and adapted to be attached to a source of water, said device including a valve and a spring to maintain said valve closed when said device is detached from the source of water to maintain any water in said hose.

5. The device of claim 1 wherein said spray head has a top surface with an aperture therein, said plunger extending through said aperture.

6. The device of claim 1 further comprising generally radially directed spray apertures in said spray head.

7. The device of claim 1 wherein said plunger includes a stem extending upwardly from said base, said nose being received over said stem, said nose being thereby removable from said base.

8. The device of claim 7 wherein said nose has an outer tapered wall.

9. A device for emitting water into the inside of a container comprising a tube having one end adapted to be attached to a source of water, a spray head carried by the other end of said tube, a plunger including a nose at one end normally extending out of said spray head and a base at the other end, said base including a stem, a shelf formed in said spray head, a seal having a surface the majority and less than all of which is received on said shelf, at least one rib extending from said shelf to press into one side of said seal, said base having a rim to press into the other side of said seal, and a spring between said tube and said base, and received around said stem, to urge said nose out of said spray head.

10. The device of claim 9 wherein at least eighty percent of the surface of said seal is received on said shelf.

11. A device for emitting water into the inside of a container comprising a tube having one end adapted to be attached to a source of water, a spray head carried by the other end of said tube, a plunger including a nose at one end normally extending out of said spray head and a base at the other end, a shelf formed in said spray head, a seal having a surface the maiority and less than all of which is received on said shelf, at least one rib extending from said shelf to press into one side of said seal, said base having a rim to press into the other side of said seal, a hose having one end attached to said one end of said tube, and a device at the other end of said hose and adapted to be attached to a source of water, said device including a valve and a spring to maintain said valve closed when said device is detached from the source of water to maintain any water in said hose.

12. The device of claim 11 further comprising a spring in said spray head urging said one end of said plunger out of said spray head.

* * * * *